US010253530B2

(12) United States Patent
Savant et al.

(10) Patent No.: US 10,253,530 B2
(45) Date of Patent: Apr. 9, 2019

(54) VEHICLE UNLOCKING CONTROL DEVICE PROVIDED WITH AN OUTER CONTROL MEMBER HAVING AN OVER-MOLDED MOUNTING

(75) Inventors: Fiorenzo Savant, Pianezza (IT); Vittorio Giaccone, Pianezza (IT); Guillaume Lesueur, Creteil (FR)

(73) Assignee: U-Shin Italia S.p.A., Pianezza (IT)

( * ) Notice: Subject to any disclaimer, the term of this patent is extended or adjusted under 35 U.S.C. 154(b) by 254 days.

(21) Appl. No.: 13/394,557

(22) PCT Filed: Nov. 19, 2010

(86) PCT No.: PCT/EP2010/067811

§ 371 (c)(1),
(2), (4) Date: Mar. 7, 2012

(87) PCT Pub. No.: WO2011/061281

PCT Pub. Date: May 26, 2011

(65) Prior Publication Data

US 2012/0167642 A1 Jul. 5, 2012

(30) Foreign Application Priority Data

Nov. 20, 2009 (IT) ..... MI2009A2045

(51) Int. Cl.
*E05B 17/10* (2006.01)
*E05B 81/76* (2014.01)
(Continued)

(52) U.S. Cl.
CPC ..... *E05B 81/76* (2013.01); *E05B 85/14* (2013.01); *E05B 17/10* (2013.01); *E05B 81/77* (2013.01);
(Continued)

(58) Field of Classification Search
CPC ..... E05B 85/16; E05B 85/18; E05B 81/78; E05B 17/22; E05B 81/77; E05B 81/76;
(Continued)

(56) References Cited

U.S. PATENT DOCUMENTS 2,219,626 A * 10/1940 John ..... E05B 13/002 292/336.3
6,527,316 B1 * 3/2003 Agostini ..... E05B 85/10 292/336.3
(Continued)

FOREIGN PATENT DOCUMENTS

DE 10 2005 055515 A1 2/2007
DE 10 2006 029774 A1 1/2008
(Continued)

OTHER PUBLICATIONS

International Search Report w/translation from PCT/EP2010/067811 dated May 10, 2011 (6 pages).
(Continued)

*Primary Examiner* — Kristina R Fulton
*Assistant Examiner* — Faria F Ahmad
(74) *Attorney, Agent, or Firm* — Burris Law, PLLC

(57) ABSTRACT

The invention relates to a vehicle handle unlocking control device which includes: a motor vehicle door leaf handle, the handle including a member for receiving a command from outside the device, an output signal electronic processing unit of the member, and a mounting which is over-molded over at least a portion of the receiving member and separate from the unit, whereby the over-molded mounting does not cover any output signal electronic processing unit of the receiving member.

14 Claims, 2 Drawing Sheets

(51) Int. Cl.

| | |
|---|---|
| ***E05B 85/10*** | (2014.01) |
| ***E05B 85/14*** | (2014.01) |
| ***E05B 85/16*** | (2014.01) |
| ***E05B 85/18*** | (2014.01) |
| ***E05B 3/00*** | (2006.01) |
| *E05B 81/78* | (2014.01) |

(52) U.S. Cl.
CPC ..... *E05B 81/78* (2013.01); *E05B 85/107* (2013.01); *E05B 85/16* (2013.01); *E05B 85/18* (2013.01); *Y10T 70/5155* (2015.04); *Y10T 292/57* (2015.04)

(58) Field of Classification Search
CPC ..... E05B 85/14; E05B 17/10; E05B 85/107; Y10T 292/57; Y10T 70/5155
USPC ..... 292/336.3, DIG. 22, DIG. 23, DIG. 30, 292/DIG. 31; 16/110.1
See application file for complete search history.

(56) References Cited

U.S. PATENT DOCUMENTS 6,626,473 B1 * 9/2003 Klein ..... B29C 45/1676 200/302.2
6,768,413 B1 * 7/2004 Kemmann ..... G07C 9/00309 307/10.1
6,871,887 B2 * 3/2005 Jooss ..... E05B 81/78 292/336.3
7,132,768 B2 * 11/2006 Ieda ..... E05B 81/78 307/652
7,140,653 B2 * 11/2006 Kobayashi ..... E05B 79/06 292/348
7,152,893 B2 * 12/2006 Pudney ..... E05B 13/002 292/336.3
7,198,308 B2 * 4/2007 Lane ..... E05B 79/12 292/336.3
7,273,991 B2 * 9/2007 Korultay ..... E05B 81/76 200/520
7,284,776 B2 * 10/2007 Cummins ..... E05B 77/04 292/336.3
7,331,618 B2 * 2/2008 Jooss ..... E05B 81/78 292/336.3
7,350,949 B2 * 4/2008 Meinke ..... B60Q 1/2669 362/540
7,375,299 B1 * 5/2008 Pudney ..... E05B 81/78 200/61.62
7,407,203 B2 * 8/2008 Huizenga ..... E05B 77/06 292/347
7,445,257 B2 * 11/2008 Mulle ..... E05B 81/78 292/336.3
7,513,544 B2 * 4/2009 Cummins ..... E05B 47/004 292/336.3
7,600,795 B2 * 10/2009 Cummins ..... E05B 47/004 292/336.3
7,819,442 B2 * 10/2010 Ieda ..... B60R 25/24 292/336.3
8,333,492 B2 * 12/2012 Dingman ..... B60Q 1/2665 362/501
8,575,506 B2 * 11/2013 Kitahara ..... H01H 13/06 200/302.2
8,601,903 B1 * 12/2013 Klein ..... E05B 81/78 16/110.1
8,707,568 B2 * 4/2014 Osawa ..... B25F 5/02 16/110.1
8,801,245 B2 * 8/2014 De Wind ..... B60Q 1/2619 362/511
8,904,835 B2 * 12/2014 Bohm ..... E05B 81/77 292/336.3
9,016,735 B2 * 4/2015 Lesueur ..... E05B 77/06 292/336.3
9,279,272 B2 * 3/2016 Noda ..... E05B 81/77
9,353,557 B2 * 5/2016 Sanborn ..... E05B 85/14
9,394,729 B2 * 7/2016 Da Deppo ..... E05B 85/16
9,404,292 B2 * 8/2016 Da Deppo ..... E05B 77/06
9,487,974 B2 * 11/2016 Saitou ..... H01H 13/06
9,834,964 B2 * 12/2017 Van Wiemeersch .... E05B 85/14
2002/0046439 A1 * 4/2002 Agostini ..... E05B 81/76 16/110.1
2003/0101781 A1 * 6/2003 Budzynski ..... E05B 85/10 70/239
2003/0122556 A1 * 7/2003 Sueyoshi ..... B60R 25/246 324/686
2004/0075531 A1 * 4/2004 Ieda ..... B60R 25/246 340/5.72
2004/0104815 A1 * 6/2004 Suyama ..... B60Q 1/323 340/426.16
2004/0223336 A1 * 11/2004 Murakami ..... B60Q 1/2669 362/501
2004/0227203 A1 * 11/2004 Wu ..... 257/474
2004/0232710 A1 * 11/2004 Jooss ..... E05B 81/78 292/336.3
2004/0233677 A1 * 11/2004 Su ..... B60Q 1/2669 362/501
2004/0262139 A1 * 12/2004 Ieda ..... E05B 81/76 200/341
2005/0047162 A1 * 3/2005 Baek ..... B60Q 1/2669 362/501
2005/0212307 A1 * 9/2005 Lane ..... E05B 79/12 292/336.3
2005/0285717 A1 * 12/2005 Ieda ..... B60Q 1/2669 340/5.72
2006/0038417 A1 * 2/2006 Pudney ..... E05B 13/002 292/336.3
2006/0038418 A1 * 2/2006 Huizenga ..... E05B 77/06 292/336.3
2006/0226953 A1 * 10/2006 Shelley ..... B60R 25/00 340/5.62
2007/0227203 A1 * 10/2007 Weber ..... E05B 81/78 70/91
2008/0290668 A1 * 11/2008 Ieda ..... B60R 25/24 292/198
2008/0314097 A1 * 12/2008 Rohlfing ..... E05B 81/78 70/256
2009/0133510 A1 * 5/2009 Witte et al. ..... E05B 81/78 73/862.626
2010/0237635 A1 * 9/2010 Ieda ..... E05B 81/78 292/336.3
2011/0012378 A1 * 1/2011 Ueno ..... B29C 45/14811 292/336.3
2012/0000256 A1 * 1/2012 Stuckey ..... E05B 35/008 70/91
2012/0139296 A1 * 6/2012 Wilkens ..... E05B 83/243 296/193.11
2012/0166023 A1 * 6/2012 Hara ..... E05B 81/78 701/2
2012/0280520 A1 * 11/2012 Wellborn, Sr. ..... E05B 81/04 292/336.3
2013/0081251 A1 * 4/2013 Hultberg ..... E05B 47/026 29/428
2013/0187394 A1 * 7/2013 Lesueur ..... E05B 77/06 292/336.3
2014/0000167 A1 * 1/2014 Patel ..... E05B 81/34 49/32
2014/0015263 A1 * 1/2014 Da Deppo ..... E05B 85/16 292/336.3
2014/0117683 A1 * 5/2014 Saitou ..... E05B 79/06 292/336.3
2014/0239650 A1 * 8/2014 Kato ..... B60J 5/0487 292/336.3

FOREIGN PATENT DOCUMENTS

DE 102006029774 A1 * 1/2008 ..... E05B 81/78
DE 102012100428 A1 * 7/2013 ..... E05B 81/77
EP 1 369 546 A1 12/2003
EP 1 674 641 A1 6/2006
EP 1 760 227 A1 3/2007
EP 1760227 A1 * 3/2007 ..... B60R 25/24

(56) References Cited

FOREIGN PATENT DOCUMENTS

| | | | | | |
|---|---|---|---|---|---|
| EP | 1 840 845 | A2 | | 10/2007 | |
| EP | 2148025 | A2 | * | 1/2010 | ..... E05B 81/78 |
| EP | 2275243 | A1 | * | 1/2011 | ..... B29C 45/14811 |
| FR | 2 819 538 | A1 | | 7/2002 | |
| JP | WO 2009017047 | A1 | * | 2/2009 | ..... B60R 25/00 |
| JP | WO 2009017048 | A1 | * | 2/2009 | ..... B60R 25/00 |
| JP | WO 2009017049 | A1 | * | 2/2009 | ..... B60R 25/246 |
| WO | 2005/008003 | A1 | | 1/2005 | |
| WO | 2009/019221 | A2 | | 2/2009 | |
| WO | WO 2009017047 | A1 | * | 2/2009 | ..... E05B 1/00 |
| WO | WO 2009017048 | A1 | * | 2/2009 | ..... E05B 1/00 |
| WO | WO 2009017049 | A1 | * | 2/2009 | ..... E05B 1/00 |
| WO | WO 2011061281 | A2 | * | 5/2011 | ..... E05B 81/76 |

OTHER PUBLICATIONS

Written Opinion from PCT/EP2010/067811 dated May 10, 2011 (5 pages).

* cited by examiner

VEHICLE UNLOCKING CONTROL DEVICE PROVIDED WITH AN OUTER CONTROL MEMBER HAVING AN OVER-MOLDED MOUNTING

The invention relates to vehicle handles.

The travel of certain components inside a vehicle handle means that volumes need to be left free within this handle. Moreover, the handles are often provided with electronic devices that control the unlocking of the handle. Document WO 2009/019221 for example discloses a handle of this type. For example, a sensor detects contact of a hand with the handle and then another sensor of the vehicle detects the presence, in close proximity of the vehicle, of a characteristic element such as a key comprising radiofrequency antenna, thus identifying the driver. Once this identification has been made, these members command the unlocking of the vehicle so that the driver can enter the vehicle. Certain electrical and electronic elements have to be positioned in the handle with due consideration to the aforementioned volumes that have to be left free. This is why attempts are made to make such members as compact as possible.

It is one object of the invention to make it easier for the electrical and electronic elements to be integrated into the handle.

To this end, the invention provides a device for controlling the unlocking of a motor vehicle, which comprises:

- a motor vehicle door leaf handle, the handle including a member for receiving a command from outside the device,
- an electronic signal processing unit for processing signals output by the member, and
- a mounting overmolded on at least part of the receiver member and independent of the unit such that the overmolded mounting does not cover any electronic signal processing unit for processing signals output by the receiver member.

Thus, the receiver member can be positioned at will with respect to the unit and separate from the latter to which it is connected at the very most by flexible electrical connection leads. The spatial configuration of the device can thus be adapted to suit that of the handle so as not to encroach upon the volumes that have to be left free in order to allow certain handle components to move.

The device according to the invention may further exhibit at least any one of the following features:

- the receiver member comprises a capacitive sensor, preferably one comprising electrodes that are at least partially embedded in the mounting;
- the receiver member comprises a piezoelectric sensor or a pressure sensor that is at least partially embedded in the mounting;
- the receiver member comprises a switch;
- the receiver member comprises a moving button fixed in a fluidtight manner to the mounting; and
- the processing unit bears at least one light source.

In the latter instance, the unit thus constitutes a member which illuminates the handle during unlocking for example.

The invention also provides a vehicle handle which comprises a device according to the invention, the receiver member being arranged in such a way as to be actuated from outside the handle and preferably extending some distance from the processing unit.

For preference, the handle comprises:

- a first part bearing the receiver member; and
- a second part mounted able to move with respect to the first part and extending on a side of the receiver member that is the opposite side to a side of the member that is sensitive to the command.

For preference, the second part is mounted such that it can move toward the first part.

In one embodiment, provision may be made that the receiver member and the processing unit are mounted without the ability to move one relative to the other.

In another embodiment, provision may be made that the receiver member and the processing unit are fixed to components of the handle that are mounted with the ability to move one relative to the other.

For preference, the handle comprises a lock operated by a key.

Finally, the invention provides a vehicle door leaf which comprises a handle according to the invention, the receiver member preferably being fixed rigidly to a component of the handle, itself rigidly fixed to a main external panel of the door leaf.

Further features and advantages of the invention will become further apparent from the following description of some embodiments given by way of nonlimiting examples with reference to the attached drawings in which.

Figure 1:
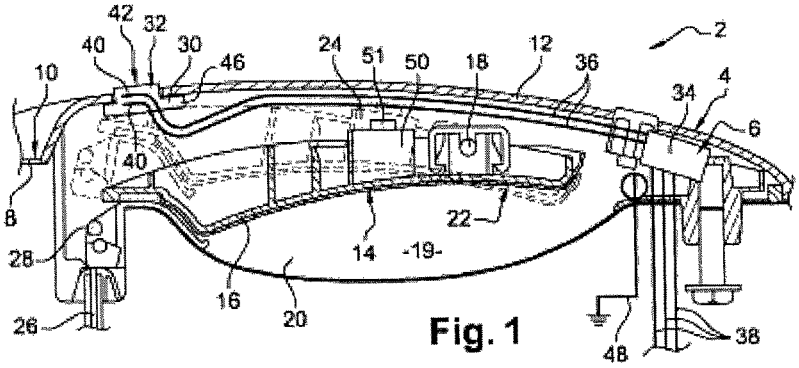
FIG. 1 is a view in horizontal section of a handle mounted on a vehicle door leaf in a first embodiment of the invention.

FIG. 1 illustrates, in a first embodiment, a door leaf 2, such as a motor vehicle front door, equipped with a handle 4 comprising a locking and unlocking control device 6 according to the invention. The door leaf 2 notably comprises a main external panel 8 which, via its external face 10, gives the door leaf its external appearance.

The handle comprises a fixed part 12 formed, in this instance, by a component such as a cover. The cover 12 is rigidly fixed to the panel 8 opposite the external face 10.

The handle comprises a moving part 14 notably comprising a lever or trigger 16 mounted so that it can rotate with respect to the cover 12 about a vertical axis 18. FIG. 1 thus in solid line illustrates the position of the lever 16 at rest with the components it bears and, in chain line, the position it occupies when it is moved closer to the cover 12. The lever 14 extends between the external face 10 of the panel 8 and an internal face of the cover 12. Facing the cover 12 and the lever 16, the panel 8 has an indentation or cavity 19 allowing a user to insert the tips of his fingers 20 in order to operate the lever 16 to bring it closer to the cover 12. The lever 16 for this purpose, opposite the panel 8, has a concave curved face 22 that increases the volume of the cavity 19.

The handle comprises a main return spring 24 which, on completion of the maneuver, returns the lever 16 to the rest position. The handle comprises a cable 26 with one end 28 attached to the lever 16 so that the movement of the latter causes the cable to move over a travel c indicated in FIG. 1.

The handle unlocking control device 6 comprises a member 30 extending partially through a through-opening 32 in the cover 12. The member 30 is rigidly fixed to the latter.

The control device also comprises an electronic processing unit 34 connected to the member 30 by flexible leads or wires 36. The device also comprises leads 38, in this instance three of them, connecting the unit 34 to the vehicle locking members or to a centralized control device therefor. Unit 34 here is rigidly fixed to the cover 12 extending opposite an internal face of the latter that faces toward the panel 8.

The member 30 in this particular instance comprises a capacitive sensor comprising two electrodes 40 that form a capacitor made up of the majority of the member 30. The member is designed so that contact of a finger belonging to the user with an external face 42 of the sensor that emerges through the opening 32 alters the capacitance of the capacitor, which alteration is detected by the unit 34 and interpreted to command the locking or unlocking depending on whether the vehicle is respectively already unlocked or locked at that moment in time.

Thus, the unit 34 receives a signal from the capacitive sensor, it interprets this signal through electronic processing and delivers an on/off signal indicating whether the vehicle is locked or unlocked. The unit 34 before sending this on/off signal encodes it with an encoding that is decrypted downstream by a vehicle central locking/unlocking unit.

In a way well known to those skilled in the art, the interpretation of the output signal performed by the unit 34 may be a comparison against a threshold, sinusoid-amplitude measurement, a measurement of the number of pulses needed to charge a downstream capacitor, a measurement of variation in frequency, etc.

To do that, the electrodes of the sensor may be powered with the DC voltage of the vehicle battery or with a sinusoidal voltage or current delivered by a system central to the vehicle or delivered by the unit 34 itself.

The same type of signal processing of the output signal from the member is also performed when the member 30, in other embodiments of the invention, is a mechanical pressure sensor, a piezoelectric member, or even a contact switch, whether this be the interpreting of the output signal and/or the encoding thereof.

The present control device comprises a mounting 46 overmolded over at least part of the member 30. This mounting is made of a rigid material such as a plastic, a resin, etc. The electrodes 40 are at least partially and, in this particular instance fully, embedded within this mounting and are thus protected from external attack (moisture, corrosion, knocks, etc.).

The mounting 46 is independent of the unit 34 and notably able to move with respect to the latter before the unlocking device is mounted in the handle. The unit 34 has its own mounting, separate and distant from the mounting 46. The member 30 can thus be positioned at will with respect to the unit 34 in the handle, the member and the unit being connected to one another only by the leads 36.

Provision may be made for the cover 12 to be covered with an electrically conductive coating such as a chrome plating or a paint. In order not to disrupt the operation of the device, a lead 48 is provided to electrically ground this coat.

As in all the other embodiments described in the present application, the handle is equipped with a mechanical lock 49 and with a key 53. These have been illustrated in the embodiment of FIG. 6.

With reference to FIG. 1, the handle comprises a lighting module 50 comprising at least one light source such as a light-emitting diode 51. This module illuminates at least part of the handle when the receiver member is actuated, this illumination being associated with a timer which ensures that the light is extinguished after a certain time period has elapsed.

The handle works as follows. The user places a finger such as his thumb on the face 42 of the member which thus receives a command from outside the device. That alters the capacitance of the capacitor. This alteration, transmitted along the leads 36, is received in the unit 34 which then via the leads 38 transmits a command to unlock the door. To open the door, the user operates the handle by inserting his fingers 20 into the cavity 19 and pulling the lever 16 closer to the cover 12, more specifically moving the lever 16 toward the internal face of the cover and toward the sensor, and this is what opens the door leaf in order to gain access to the vehicle interior.

The unit 34, placed within the handle in this embodiment, can, thanks to the invention, be sited remotely from the handle and, for example, be mounted on the wiring leaving the handle.

Figure 2:
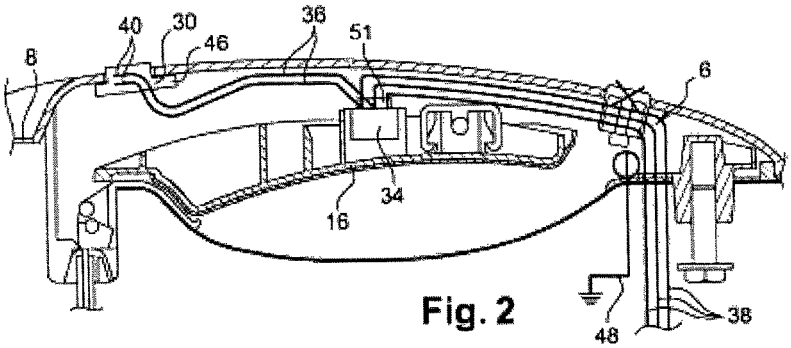
FIGS. 2 and 3 are similar views illustrating second and third embodiments.

In the second embodiment illustrated in FIG. 2, the only difference with regard to the embodiment of FIG. 1 is the positioning of the processing unit 34. Specifically, the latter is this time fixed rigidly to the moving part 14 and to the lever 16, opposite a face of this part that faces the cover 12. The unit 34 is therefore mounted such that it can move with respect to the member 30. Further, the unit 34 incorporates the lighting module 50 in this particular example. As an alternative, provision may be made for other functions other than that of the lighting module 50 to be incorporated into the unit 34.

Figure 3:
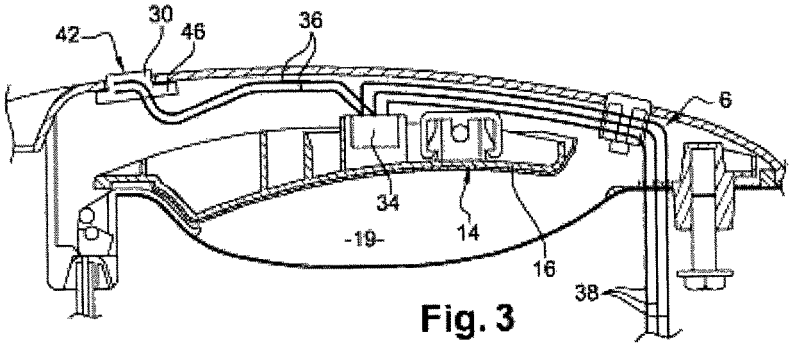
Figure 4:
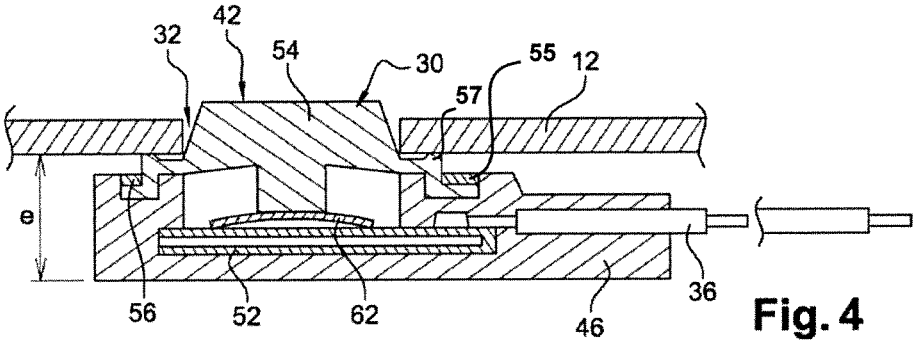
FIG. 4 is a similar view showing the detail of the receiver member of the third embodiment.

With reference to FIGS. 3 and 4, in the third embodiment, once again the unit 34 incorporates the lighting module 50. Further, in the receiver member 30 the capacitive sensor is replaced by a pressure sensor or, as an alternative, a piezoelectric sensor. The sensor 52 is at least partially embedded in the overmolded mounting 46. The latter thus covers the lateral and lower faces of the sensor 52, together with a fraction of its top face.

The member 30 in this particular instance comprises a button 54, such as a membrane button, that passes through the opening 32 in the cover 12. A peripheral rim 55 of the button 54 is housed in an upper groove of the mounting 46. The rim 55 of the button 54 is covered at the top of the groove with a coat of a sealing material 56 such as an adhesive or a resin. The attachment of the button 54 to the mounting 46 performed in this way provides a fluidtight joint between these items and protects the upper face of the sensor 52 which is not covered by the material of the mounting 46. Interposed between the button 54 and the sensor 52 is a switch 62 which in this example involves a dished metal element. However, this element is not compulsory. Its function is merely to allow the user to feel a "click" when he presses the button 54. It has no electrical function in this example. The dished element is in the shape of a portion of a sphere of which a lower edge that forms a parallel is in contact with one face of the sensor 52 whereas the pole that forms its vertex bears against the base of the button 54. The ends of the leads 36 are soldered to the sensor 52 or connected thereto by crimping. In addition, the material of the mounting 46 is overmolded so that it fully covers these ends. In this particular instance, the entity may have a thickness e of around 5 mm, this thickness being measured from the internal underside of the cover 12 to the underside of the mounting 46. Naturally, provision could be made for the unit 34 to be produced in accordance with the embodiment of FIG. 1. In this particular instance, the presence of the grounding lead is not necessary, even if a conductive coating is present.

As also shown in FIG. 4, according to one or more embodiments, the button 54 further comprises a medial rim 57 between a central portion of the button 54 that moves and the peripheral rim 55. As shown in FIG. 4, the medial rim 57 is directly attached to the fixed component 12 in one or more embodiments.

Figure 5:
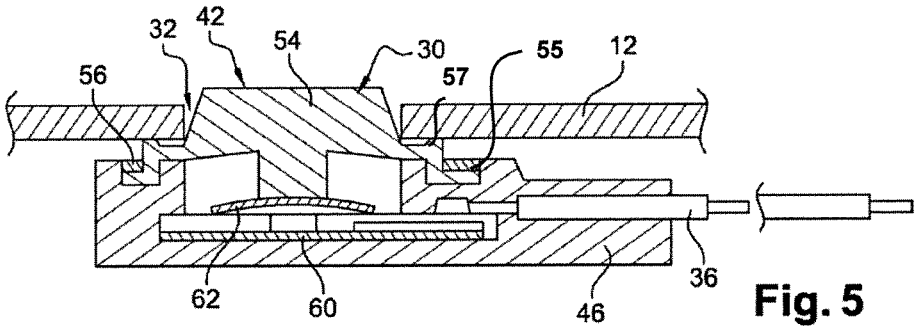
FIG. 5 is a view similar to the previous one showing a fourth embodiment of the invention.

The fourth embodiment illustrated in FIG. 5 differs from the preceding one only in that the member 30 comprises not a sensor but a printed circuit 60 controlled by a switch 62, in this particular instance once again with a dished metal element arranged in the same way as in the previous embodiment, but this time having an electrical switching function. The printed circuit occupies the space of the pressure sensor from the embodiment of FIG. 4. The other elements have the same configuration, including the button 54. The thickness of this arrangement is the same as that indicated for the previous embodiment.

In the two embodiments illustrated in FIGS. 4 and 5, the user operates the moving button 54 to command unlocking and locking, depending on the current state of the vehicle.

However, the invention applies to a member dedicated to receiving a locking command only or to receiving an unlocking command only.

Figure 6:
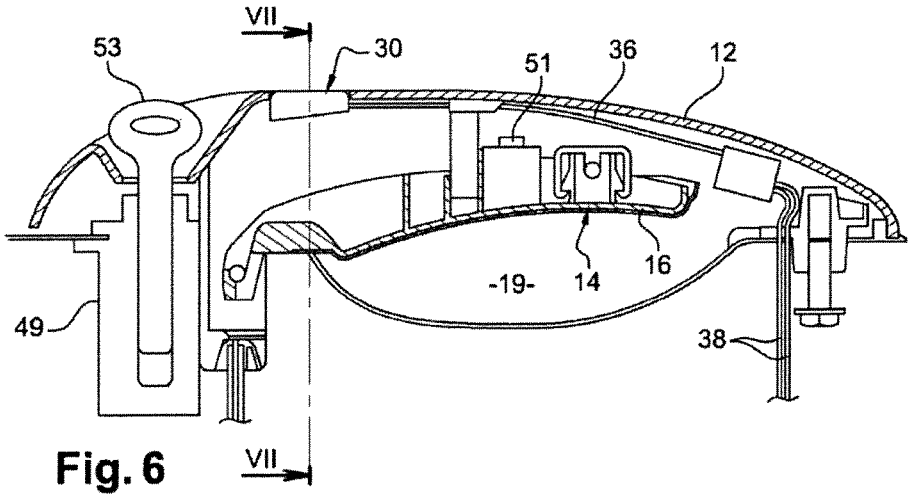
FIG. 6 is a view similar to FIG. 1 illustrating a fifth embodiment of the invention.
Figure 7:
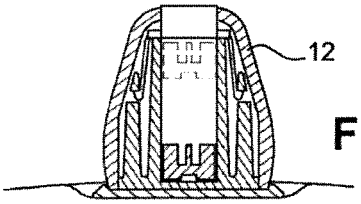
FIG. 7 is view in section on VII-VII of the device of FIG. 6.

The embodiment of FIGS. 6 and 7 illustrates a detailed way of implementing the embodiment shown in FIG. 1, and also shows the key 53 which operates the lock 49 for mechanical unlocking. Indeed it is still possible to use this key and this lock to command the unlocking of the door without involving the unlocking control device 6.

Because the mounting 46 is independent of the unit 34, there is a great deal of choice as to where to site the unlocking control device within the handle. The travel space required for the other components of this handle can therefore be created. The receiver member 30 intended to be in contact with the user can be positioned in the place that is the most comfortable for this user for good ergonomics. The embodiments of FIGS. 3 and 5 can be used by an individual wearing gloves. The invention also suitably protects the device against water and corrosive agents. The invention is compatible with the use of an electrically conductive coating.

Each of these embodiments is compatible with the further presence of a presence sensor capable of communicating with a radiofrequency antenna worn or carried by the user so as to recognize the latter in order to validate the unlocking. The electronic member or members that carry out this recognition may be fully or partially incorporated into the unit 34.

Of course, numerous modifications may be made to the invention without departing from the scope thereof.

The layout of the handle or its mechanism may differ from those discussed above. The lever may form an external component of the handle. It may be mounted with the ability to move about a horizontal axis of rotation for example.

The invention claimed is:

1. A vehicle handle for a door leaf of a vehicle, the vehicle handle comprising:
- a device for controlling the locking or unlocking of the vehicle handle, the device comprising:
  - a receiving member configured to receive a command from outside the device;
  - an electronic signal processing unit configured to receive signals output by the receiving member, process the signals received therefrom, and output an output signal; and
  - a mounting overmolded on at least part of the receiving member and independent of the electronic signal processing unit such that the overmolded mounting does not cover any electronic signal processing unit for processing signals output by the receiving member,
  - the receiving member being arranged to be actuated from outside the handle, and extending away from the electronic signal processing unit,
- wherein the handle further comprises:
  - a fixed component bearing the receiving member such that the receiving member is mounted to the fixed component, the fixed component being configured to be rigidly coupled to a main external panel of the door leaf so that the fixed component is stationary relative to the main external panel; and
  - a lever mounted and able to move with respect to the fixed component and extending on a side of the receiving member that is opposite to a side of the receiving member that is sensitive to the command,
- wherein the lever is mounted to move toward the fixed component,
- wherein the receiving member comprises a moving button fixed in a fluidtight manner to the mounting, the moving button being configured to be actuated independent of the lever, and
- wherein the electronic signal processing unit is fixed to the lever for movement with the lever relative to the fixed component.

2. The vehicle handle as claimed in claim 1, wherein the receiving member and the electronic signal processing unit are mounted without the ability to move one relative to one another.

3. The vehicle handle as claimed in claim 1, wherein the receiving member and the electronic signal processing unit are fixed to components of the vehicle handle that are mounted with the ability to move one relative to one another.

4. The vehicle handle as claimed in claim 1, further comprising a lock operated by a key.

5. The vehicle handle as claimed in claim 1, further comprising an at least partial covering that is electrically conductive.

6. A vehicle door leaf, comprising:
- a main external panel;
- a vehicle handle comprising a device for controlling the locking or unlocking of the vehicle handle, the device comprising:
  - a receiving member configured to receive a command from outside the device;
  - an electronic signal processing unit configured to receive signals output by the receiving member, process the signals received therefrom, and output an output signal; and
  - a mounting overmolded on at least part of the receiving member and independent of the electronic signal processing unit such that the overmolded mounting does not cover any electronic signal processing unit for processing signals output by the receiving member,
  - the receiving member being arranged to be actuated from outside the handle, and extending away from the electronic signal processing unit, and
  - the receiving member being mounted to a fixed component of the handle, wherein the fixed component of the handle is rigidly coupled to the main external panel of the vehicle door leaf so that the fixed component is stationary relative to the main external panel, wherein the handle further comprises:

the fixed component, the fixed component bearing the receiving member such that the receiving member is mounted to the fixed component; and a lever mounted and able to move with respect to the fixed component and extending on a side of the receiving member that is opposite to a side of the receiving member that is sensitive to the command, wherein the lever is mounted to move toward the fixed component, wherein the receiving member comprises a moving button fixed in a fluidtight manner to the mounting, and wherein the electronic signal processing unit is rigidly fixed to the lever for movement with the lever relative to the fixed component.

7. The vehicle door leaf as claimed in claim 6, wherein an electronically conductive partial covering is one selected from a group consisting of a conductive chrome plating or a conductive paint.

8. The vehicle handle as claimed in claim 1, wherein the receiving member comprises a capacitive sensor including electrodes that are at least partially embedded in the mounting.

9. The vehicle handle as claimed in claim 1, wherein the receiving member comprises a piezoelectric sensor or a pressure sensor that is at least partially embedded in the mounting.

10. The vehicle handle as claimed in claim 1, wherein the receiving member comprises a switch.

11. The vehicle handle as claimed in claim 1, wherein the electronic signal processing unit bears at least one light source.

12. The vehicle handle as claimed in claim 1, wherein the fixed component is a cover.

13. The vehicle door leaf as claimed in claim 6, wherein a fixed component is a cover.

14. The vehicle door leaf as claimed in claim 6, wherein the receiving member is configured to be actuated independent of movement of the lever.

* * * * *